US005474423A

United States Patent [19]

Seeley et al.

[11] Patent Number: 5,474,423

[45] Date of Patent: Dec. 12, 1995

[54] BUCKET AND WHEEL DOVETAIL DESIGN FOR TURBINE ROTORS

[75] Inventors: Robert E. Seeley, Broadalbin; James H. Vogan, Schenectady, both of N.Y.

[73] Assignee: General Electric Co., Schenectady, N.Y.

[21] Appl. No.: 321,949

[22] Filed: Oct. 12, 1994

[51] Int. Cl.[6] ..... F01D 5/32

[52] U.S. Cl. ..... 416/222; 416/219 R

[58] Field of Search ..... 416/222, 217, 416/219 R, 248

[56] References Cited

U.S. PATENT DOCUMENTS

| | | | |
|---|---|---|---|
| 2,277,484 | 3/1942 | Flanders | 416/219 R |
| 3,045,968 | 7/1962 | Willis | 416/219 R |
| 3,079,681 | 3/1963 | Fentiman | 416/219 R |
| 4,702,673 | 10/1987 | Hansen et al. | 416/217 |
| 4,824,328 | 4/1989 | Pisz et al. | 416/248 |
| 5,147,180 | 9/1992 | Johnson | 416/219 R |
| 5,160,242 | 11/1992 | Brown | 416/219 R |
| 5,176,500 | 1/1993 | Heinig | 416/219 R |

FOREIGN PATENT DOCUMENTS

| | | | |
|---|---|---|---|
| 2238581 | 6/1991 | United Kingdom | 416/219 R |

*Primary Examiner*—Edward K. Look
*Assistant Examiner*—Mark Sgantzos
*Attorney, Agent, or Firm*—Nixon & Vanderhye

[57] ABSTRACT

A dovetail joint between a rotor wheel and a bucket includes a male dovetail component on the rotor wheel and a female dovetail component in the bucket, wherein the male dovetail component includes four laterally projecting hooks, each hook from an uppermost hook to a lowermost hook decreasing in radial thickness and increasing in axial length. Each hook has a substantially flat top surface to effectively increase the average thickness, and a neck between the respective hooks having enlarged fillets. The new dovetail joint reduces peak stresses so as to avoid or minimize stress corrosion cracking.

15 Claims, 2 Drawing Sheets

Fig. 3
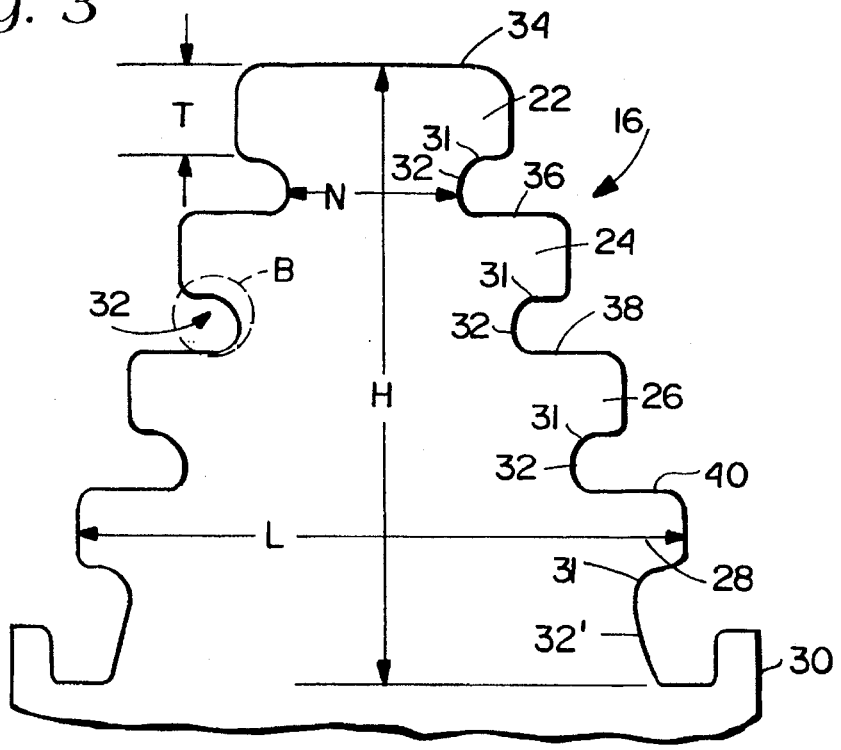
Fig. 4
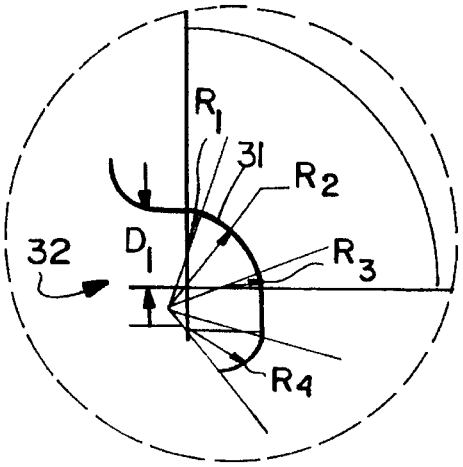
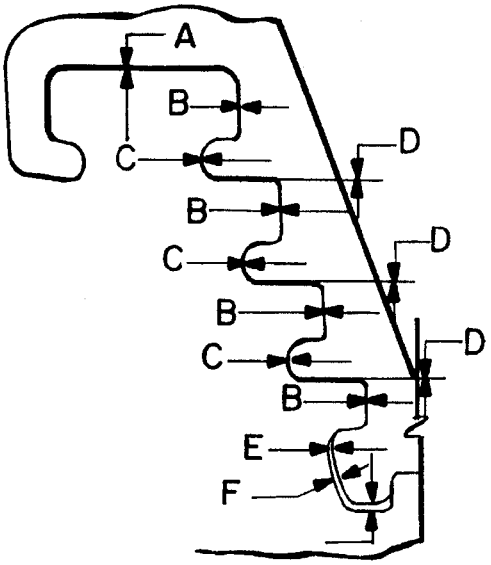
Fig. 5

BUCKET AND WHEEL DOVETAIL DESIGN FOR TURBINE ROTORS

TECHNICAL FIELD

This invention relates to steam turbines in general, and to the dovetail attachment between steam turbine rotors and steam turbine buckets in particular.

BACKGROUND

Dovetail attachment techniques between turbine buckets and turbine rotor wheels are well known in the art. It has been found, however, that conventional tangential entry dovetails on the latter stages of low pressure rotors operate in an environment that is conducive to stress corrosion cracking (SCC). SCC is accelerated by the stress levels that are present in the hook fillet region of typical dovetail configurations. Normally, these stresses are acceptable, but in contaminated steam, cracks can initiate and, if left undetected, grow to a depth that may cause failure of the wheel hooks. In extreme cases, all of the hooks may fall and buckets may fly loose from the rotor.

It has been found generally that the cracking problem described above occurs primarily in wheel hooks rather than in the complementary bucket hooks. This is apparently because the steels, such as NiCrMoV, used for low pressure rotors are much less resistant to SCC than are the 12 Cr steels used for buckets. The low pressure rotor steels, however, give the optimum combination of properties available for overall low pressure rotor design considerations. Therefore, an effective means of reducing the probability of initiating SCC in the typical low pressure steam environment is not to change materials but, rather, to reduce the stresses in the wheel dovetail to acceptable levels. If the maximum stress in components operating in a corrosive environment is reduced below the yield strength of the material, the resistance to SCC is greatly improved.

DISCLOSURE OF THE INVENTION

It is thus the principal object of this invention to provide a bucket to rotor wheel dovetail attachment configuration for low pressure rotors that have peak stresses that are low enough to avoid SCC of the wheel hooks. At the same time, it is a concurrent goal to maintain the size limitations of existing steam paths.

In accordance with the exemplary embodiment of this invention, no fewer than six design features are incorporated into the steam turbine wheel hook, and each will be described briefly below. It should be kept in mind that because dovetails are symmetric about a radial plane, it is the accepted practice to refer to only half the dovetail. Thus, in the exemplary embodiment of the invention, the wheel hook (the male dovetail component) is described as including four hooks (there are actually eight hooks) as compared to the typical three hook dovetail configuration. The incorporation of an additional fourth hook distributes the centrifugal bucket load over more hooks, thereby reducing the nominal load per hook and thereby also reducing hook stresses.

In addition, the uppermost of the four hooks is made thicker than in conventional three hook designs in order to reduce the bending stress in that hook. Since the peak stress results from combined bending and tensile stresses, it follows that a reduction in bending stress will also reduce peak stress.

In the described embodiment, the hook thickness is greatest for the uppermost hook and proportionally smaller for each successive hook below the uppermost hook. Since the upper hook is the most highly stressed of the four hooks, and since hook stress continually decreases from the uppermost to the lowermost hook, the benefit of the extra thickness of the uppermost hook is not needed for the hooks below, and decreasing hook thickness contributes to minimizing the total height of the dovetail.

It has also been found that stress concentration, and therefore peak stress, decreases as the size of the fillet radius increases in the neck between hooks. In order to maximize this effect in a minimal transition distance (distance from the bottom surface of the hook to the straight portion of the dovetail neck surface), a compound fillet is employed with the largest radiused portion of the fillet spanning the region of peak stress. Thus, by minimizing the transition distance, the reduction in neck thickness and the increase in neck stress is minimized.

It is also a feature of this invention to make the top surface of each hook substantially flat rather than substantially inclined or slanted as in typical hook configurations. For purposes of discussion in this patent application, reference to the substantially flat top surface of the hooks includes a minor inclined or slanted top surface of less than 8 degrees from horizontal, preferably such minor inclination is 5 degrees or less. While it is desirable to make the inclination of the top surface as small as possible, it may be necessary in order to provide for milling cutters to machine the dovetails in the wheel and bucket to provide for such minor inclination in the substantially flat top surface. As a result of the substantially flat top surface, the neck thickness (i.e., the distance from the top surface of one wheel hook to the bottom surface of the wheel hook above), is effectively increased without significantly reducing the shear thickness or bending stiffness of the wheel hook. This arrangement provides adequate bucket hook thickness and helps to minimize the overall height of the dovetail.

Finally, the height saved by using variable thickness hooks and substantially flat top hooks partially offsets the thicker than normal top hook and the incorporation of an additional hook. As a result, the total height of the dovetail fits the space available in existing steam paths where three hook designs of comparable width are used.

It will be appreciated that the bucket hook (the female dovetail component) is shaped in a substantially complementary manner, within accepted tolerances.

Accordingly, in one aspect, the invention relates to a dovetail joint between a rotor wheel and a bucket, the joint comprising a male dovetail component on the rotor wheel and a female dovetail component in the bucket, wherein the male dovetail component includes four laterally projecting hooks, each hook from an uppermost hook to a lowermost hook decreasing in radial thickness and increasing in axial length.

In another aspect, the invention relates to a dovetail joint for attaching a turbine bucket to a rotor wheel, wherein the dovetail joint comprises a male wheel dovetail and substantially complementary female bucket dovetail; and further wherein the wheel dovetail includes a plurality of laterally extending hooks which decrease in radial thickness from an uppermost hook to a lowermost hook, and wherein each hook is formed with a substantially flat top surface.

In still another aspect, the invention relates to a dovetail joint for attaching a turbine bucket to a rotor wheel, wherein the dovetail joint comprises a male wheel dovetail and substantially complementary female bucket dovetail; and further wherein the wheel dovetail includes a plurality of laterally extending hooks; and wherein a neck joins a lower surface of one hook to the top surface of an underlying hook, the neck including an upper fillet having a plurality of radii and a lower fillet having a single radius.

Additional objects and advantages will become apparent from the detailed description which follows.

BRIEF DESCRIPTION OF THE DRAWINGS

FIG. 3 is a side section illustrating the turbine wheel dovetail in accordance with this invention;

FIG. 4 is an enlarged detail of a neck including an upper and lower fillet shown at B in FIG. 3; and FIG. 5 is a partial section of the wheel dovetail and the complementary bucket dovetail in accordance with this invention illustrating tolerance dimensions therebetween.

BEST MODE FOR CARRYING OUT THE INVENTION

Figure 1:
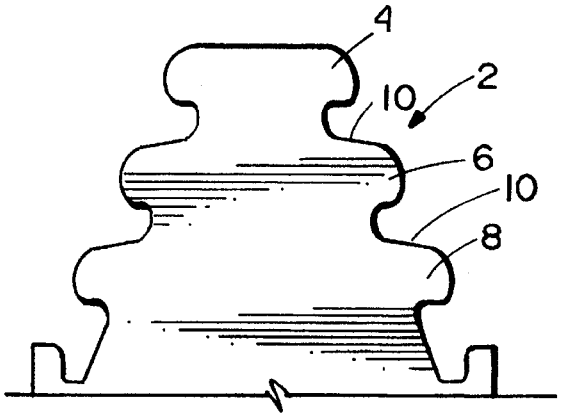
Fig. 1 (PRIOR ART)
FIG. 1 illustrates a typical turbine rotor wheel dovetail configuration in cross section.

With reference to FIG. 1, a conventional wheel dovetail 2 is formed with an upper hook 4, an intermediate hook 6 and a lower hook 8. Each hook below the uppermost hook 4 is shown generally to have a substantially inclined top surface 10, and the hooks are substantially similar in terms of thickness. The present invention as illustrated in FIGS. 2–5 incorporates several new design features which are intended to reduce concentrated stresses while minimizing increases in radial height as described above.

Figure 2:
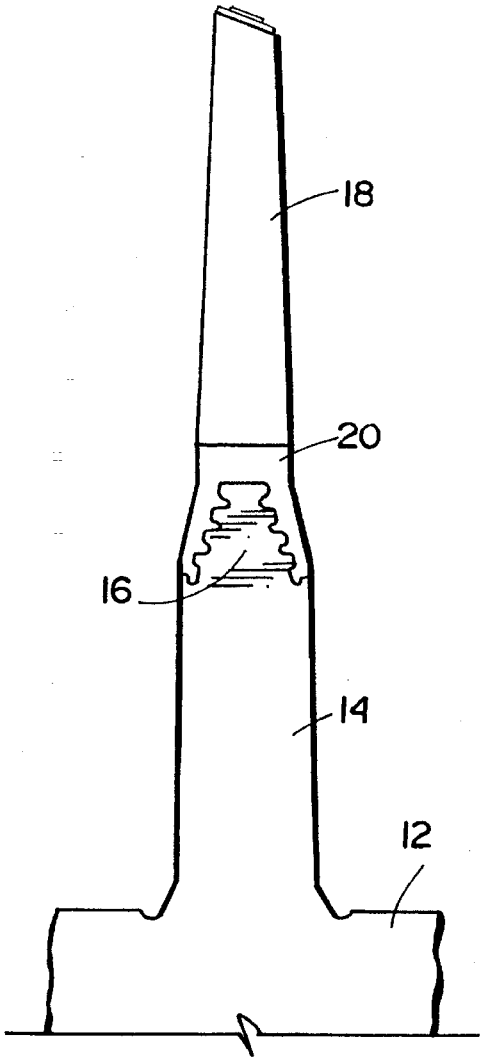
FIG. 2 is a partial side elevation of a rotor body, rotor wheel and bucket in accordance with this invention.

FIG. 2 illustrates generally a rotor body 12 with integral rotor wheel 14 and associated wheel dovetail 16. A bucket 18 including a bucket dovetail 20 is shown in place on the wheel. This is a conventional tangential entry type dovetail arrangement, but the wheel and bucket dovetail incorporate new design features in accordance with this invention.

Again, in the detailed description which follows, only half the dovetail (the right half as viewed in FIG. 3) will be discussed since the dovetails are symmetrical about a radial plane. Thus, the dovetail arrangement illustrated in FIGS. 2 and 3 is referred to as a four-hook design even though there are a total of eight hooks, i.e., four pair of laterally adjacent hooks.

The wheel dovetail 16 in accordance with this invention is described below with emphasis on no fewer than six significant design differences as compared to the conventional wheel dovetail illustrated in FIG. 1. It should also be noted here that all of the features described below with respect to the wheel dovetail will be incorporated into the complementary bucket dovetail as well. Rather than described the latter in great detail, reference will be made to tolerances between the wheel and bucket dovetails. The shapes per se are otherwise substantially similar.

Wheel dovetail 16 includes four hooks 22, 24, 26 and 28 each interconnected by a neck 32. Hook 28 is connected to a tang 30 by another neck 32'. The cross-sectional shape is sometimes referred to as a "Christmas tree" design, insofar as the successively lower hooks increase in axial length. For purposes here, axial length indicates a dimension from opposite ends of laterally adjacent hooks, i.e., the distance from the free end of one hook to the free end of an axially or laterally adjacent hook, measured in a direction parallel to the rotor. The incorporation of four rather than three hooks distributes the centrifugal bucket load over more hooks which reduces the nominal load per hook, and thereby reduces hook stresses.

The upper hook 22 is made thicker than in conventional designs, and in the exemplary embodiment, may be about $$0.634\,^{+.002}_{-.003}\text{ inch}$$

in thickness, dimension T as shown in FIG. 3. Corresponding dimensions for hooks 24, 26 and 28 are $$0.526\,^{+.002}_{-.003};\quad 0.477\,^{+.002}_{-.003};\text{ and } 0.428\,^{+.002}_{-.003}\text{ inch,}$$

respectively, when the substantially flat top surface is inclined about 5 degrees from horizontal to allow for cutter milling tolerances in the bucket dovetail. The relatively thicker upper hook 22 reduces bending stress in that hook, and since peak stress results from combined bending and tensile stresses, a reduction in bending stress will also reduce peak stress.

Moreover, the height saved by using variable thickness hooks 22, 24, 26 and 28 partially offsets the thicker than normal top hook and the additional fourth hook. As a result, the total or overall height of the dovetail fits the space available in steam paths where three hook designs of comparable width are used.

The decreasing thickness in hooks 24, 26 and 28 contributes to minimizing the total height of the dovetail, and is permitted by the fact that hook stresses generally decrease from the upper hook 22 to the lower hook 28. Thus, the benefit provided by the thicker hook 22 is not required for the remaining hooks 24, 26 and 28.

It has also been determined that stress concentration, and therefore peak stress, decreases as the radius of the upper fillet (shown generally at 31) increases. To maximize this effect in a minimal transition distance (distance from the bottom surface of a hook to the straight portion of the dovetail neck surface) a compound upper fillet 31 is employed. Such a fillet is shown in enlarged detail form in FIG. 4, and the dimensions are the same for all upper fillets between vertically adjacent hooks. The upper fillet 31 (i.e., through 90°) is comprised of three separate radii. These include, in a clockwise direction from vertical, a first radius $R_1$ of 0.110 in. extending approximately 20°; a second radius $R_2$ of 0.250 in. extending over approximately the next 50°; and a third radius $R_3$ of 0.110 in. extending over approximately the final 20°, as best shown in FIG. 4. The lower fillet may be of conventional design, including a single radiused portion designated $R_4$ which, in the exemplary embodiment is 0.0125 in. A straight portion joins the lower fillet radius $R_4$ to the upper fillet radius portion $R_3$. The largest radius $R_2$ of 0.0250 in. in the upper fillet spans the region of peak stress. By minimizing the transition distance $D_1$ (from the bottom surface of the hook to the straight section of the dovetail neck surface, 0.194 in. in the exemplary embodiment), the reduction in neck thickness and the increase in neck stress is minimized.

With reference again to FIG. 3, the top surfaces 34, 36, 38 and 40 of the respective hooks 22, 24, 26 and 28 are substantially flat. As a result, the mating bucket hook thickness (the distance from the top surface of one wheel hook to the bottom surface of the wheel hook immediately above) is effectively increased without significantly reducing the shear thickness or bending stiffness of the wheel hook. This provides adequate bucket hook thickness and helps minimize the overall height of the dovetail.

Other significant dimensions relating to the exemplary embodiment are as follows:

Dovetail Height H: 4.244 in.

Hook Axial Length $L^1$:

Hook 1 (22)—2.030 in.
Hook 2 (24)—2.840 in.
Hook 3 (26)—3.650 in.
Hook 4 (28)—4.460 in.

Neck Axial Length $N^2$:

Between Hooks 1 and 2—1.250 in.
Between Hooks 2 and 3—2.060 in.
Between Hooks 3 and 4—2.870 in.

As already noted above, the bucket dovetail geometry is substantially the same as the wheel dovetail, and need not be described in detail. It is sufficient here to note the various tolerances between the two and, to this end, reference is made to FIG. 5 and to Table I below.

TABLE I

| CLEARANCE (in) | A | B | C | D | E | F | G |
|---|---|---|---|---|---|---|---|
| MAXIMUM | .025 | .015 | .045 | .029 | .042 | .042 | .073 |
| MINIMUM | .002 | .003 | .033 | .005 | .036 | .037 | .053 |

[1]combined axial length of each hook and its counterpart on the opposite side of the dovetail.
[2]axial length between laterally adjacent fillets.

In summary, the wheel/bucket dovetail construction as described herein includes design features intended to minimize concentrated stresses caused by centrifugal forces of turbine buckets mounted on turbine rotor wheels by dovetail joints, while nevertheless maintaining an overall size which is compatible with existing steam paths.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dovetail joint between a rotor wheel and a bucket, the joint comprising a male dovetail component on the rotor wheel and a female dovetail component in the bucket, wherein the male dovetail component receives the female dovetail component in a direction tangential to the rotor wheel, and further wherein the male dovetail component includes four laterally projecting hooks, each hook from an uppermost hook to a lowermost hook decreasing in radial thickness and increasing in axial strength.

2. The dovetail joint of claim 1 wherein each hook has a substantially flat top surface.

3. A dovetail joint between a rotor wheel and a bucket, the joint comprising a male dovetail component on the rotor wheel and a female dovetail component in the bucket, wherein the male dovetail component includes four laterally projecting hooks, each hook from an uppermost hook to a lowermost hook decreasing in radial thickness and increasing in axial strength; wherein each hook has a substantially flat top surface; and further wherein a neck joins a lower surface of one hook to the top surface of an underlying hook, said neck including an upper fillet having a plurality of radii and a lower fillet having a single radius.

4. The dovetail joint of claim 3 wherein said upper fillet comprises three radii, a middle one of which is greater than radii on opposite sides thereof.

5. The dovetail joint of claim 4 wherein said middle radius is larger than said single radius in said lower fillet.

6. The dovetail joint of claim 1 wherein said female component in the bucket is substantially complimentary to said male component on the rotor wheel.

7. A dovetail joint for attaching a turbine bucket to a rotor wheel, comprising a male wheel dovetail component and a substantially complementary female bucket dovetail component wherein the male dovetail component receives the female dovetail component in a direction tangential to the rotor wheel; and further wherein said wheel dovetail component includes a plurality of laterally extending hooks which decrease in radial thickness from an uppermost hook to a lowermost hook, and wherein each hook is formed with a substantially flat top surface.

8. A dovetail joint for attaching a turbine bucket to a rotor wheel comprising a male wheel dovetail component and a substantially complementary female bucket dovetail component; said wheel dovetail component including a plurality of laterally extending hooks which decrease in radial thickness from an uppermost hook to a lowermost hook, wherein each hook is formed with a substantially flat top surface and further wherein a neck joins a lower surface of one hook to the top surface of an underlying hook, said neck including an upper fillet having a plurality of radii and a lower fillet having a single radius.

9. The dovetail joint of claim 8 wherein said upper fillet comprises three radii, a middle one of which is greater than radii on opposite sides thereof.

10. The dovetail joint of claim 9 wherein said middle radius is larger than said single radius in said lower fillet.

11. The dovetail joint of claim 7 wherein said female component in the bucket is substantially complementary to said male component on the rotor wheel.

12. A dovetail joint for attaching a turbine bucket to a rotor wheel, wherein the dovetail joint comprises a male wheel dovetail and a substantially complementary female bucket dovetail; and further wherein said wheel dovetail includes a plurality of laterally extending hooks; and wherein a neck joins a lower surface of one hook to the top surface of an underlying hook, said neck including an upper fillet having a plurality of radii and a lower fillet having a single radius.

13. The dovetail joint of claim 12 wherein said upper fillet comprises three radii, a middle one of which is greater than radii on opposite sides thereof.

14. The dovetail joint of claim 13 wherein said middle radius is larger than said single radius in said lower fillet.

15. The dovetail joint of claim 12 wherein said wheel dovetail includes four laterally projecting hooks.

* * * * *